US005183180A

United States Patent [19]

Hawkins et al.

[11] Patent Number: 5,183,180

[45] Date of Patent: Feb. 2, 1993

[54] PLASTIC REFUSE CONTAINER

[75] Inventors: Larry S. Hawkins, Charlotte, N.C.; Ulrich Beese, Wenden-Hünsborn, Fed. Rep. of Germany

[73] Assignee: Otto Industries, Inc., Charlotte, N.C.

[21] Appl. No.: 621,528

[22] Filed: Dec. 3, 1990

[51] Int. Cl.[5] ..... B65D 90/04

[52] U.S. Cl. ..... 220/908; 220/669; 220/675

[58] Field of Search ..... 220/908, 909, 669, 671, 220/675; 248/907

[56] References Cited

U.S. PATENT DOCUMENTS

| | | | |
|---|---|---|---|
| 2,181,150 | 11/1939 | Pittenger | 220/669 X |
| 3,311,257 | 3/1967 | Puente | 220/675 X |
| 3,937,355 | 2/1976 | Engebretsen | 220/908 X |
| 3,987,829 | 10/1976 | Leone | 220/675 X |
| 4,231,482 | 11/1980 | Bogan | 220/675 X |
| 4,550,849 | 11/1985 | Adsit | 220/908 X |
| 4,600,113 | 7/1986 | DeMars | 220/908 X |
| 4,771,940 | 9/1988 | Taylor | 220/908 X |

FOREIGN PATENT DOCUMENTS

| | | | |
|---|---|---|---|
| 2643041 | 8/1990 | France | 220/671 |

*Primary Examiner*—Paul T. Sewell
*Assistant Examiner*—BethAnne Cicconi
*Attorney, Agent, or Firm*—Bell, Seltzer, Park & Gibson

[57] ABSTRACT

The invention provides commercial-size refuse containers preferably formed from a thermoplastic polymer. In front loading versions, the container includes metal lifting sleeves fastened horizontally on the exterior of each side wall and there is a portion of each side wall above the lifting sleeve which extends outwardly beyond at least part of the lifting sleeve and supports the lifting sleeve during lifting of the container. One of more vertically oriented channels are provided in the container side wall behind the lifting sleeve to provide integrally formed, vertical reinforcing ribs in the container side wall. The portion of the upper side wall extending outwardly above the lifting sleeve and the integral vertical ribs behind the lifting sleeve cooperate to distribute shear forces applied to the side wall during lifting of the container so that the container can be repeatedly lifted by the lifting sleeves without damage to the side wall.

24 Claims, 4 Drawing Sheets

PLASTIC REFUSE CONTAINER

FIELD OF THE INVENTION

The invention is directed to an improved refuse container of the relatively large commercial type which is automatically lifted and inverted by mechanical refuse trucks.

BACKGROUND OF THE INVENTION

Relatively large refuse containers which are employed commercially are typically fabricated from steel and provided with a hinged lid which may be metal or plastic. These containers are usually stored outside and are exposed to the elements. Because the containers are made of steel, there is a tendency for the containers to rust, particularly in harsh environments such as coastal areas. In addition, the containers are heavy, making them difficult to transport and to handle.

These commercial refuse containers typically can hold a substantial volume of refuse, for example, in excess of 1.5 cubic meters (2 cubic yards). In order to provide lifting mechanisms for the refuse trucks, metal sleeves are attached to the container side walls to provide front loading refuse containers and/or a trunnion bar can be attached to the top of the front wall of the container to provide a rear loading container. With the metal containers, these lifting members are typically attached by welding or bolting.

Recently, attempts have been made to fabricate long lasting commercial size refuse containers from plastic materials. In the front load containers made from plastic materials, special structural modifications have been made to the container side walls where the lifting sleeve is attached in order to prevent tearing of the lifting sleeve away from the side wall. Additionally, because of the stresses expected to be applied to the container walls during the lifting operation, the containers have been fabricated from special plastic materials.

For example, U.S. Pat. No. 4,550,849 to Adsit discloses a commercial size plastic refuse container formed of a cross-linked polyethylene by rotational molding. A pair of metal lifting sleeves are in situ molded into the container side walls. The metal sleeves are disposed interiorly of the side walls of the container and are surrounded by plastic, and thus cannot readily be replaced; moreover, the container must be formed by rotational molding. The cross-linked polyethylene forming the container is used to ensure container strength, but this plastic cannot readily be recycled. In this regard, the plastic is shaped prior to initiation of the cross-linking process; thereafter, the cross-linking reaction permanently sets the shape of the molded plastic. Because the shape is permanently set by the cross-linking reaction, the plastic material cannot be recycled by heating and melting once the useful life of the container has ended.

U.S. Pat. No. 3,669,485 to Stihler discloses an open-top refuse container fabricated from fiber reinforced, hard resinous material. The end walls are provided with extra reinforcing layers so that lifting channels can be removably bolted to the side walls. Typically, glass reinforced plastics are fabricated from thermosetting plastic material and, like the cross-linked polyethylenes, these materials cannot readily be recycled.

Because of the potential durability and weight benefits which can be achieved by fabrication of commercial-size waste containers from plastic materials, substantial effort continues to be directed to the provision of such containers as evidenced by the above patents and similar commercial products. However, when cross-linked and thermosetting resins are employed to achieve the structural requirements necessary for the large containers, these containers, themselves, contribute to the growing world-wide waste problem. However, the conditions under which these containers are stored and used and the lifting operations used to empty the containers, have dictated in the past, the use of such special plastics.

SUMMARY OF THE INVENTION

This invention provides plastic refuse containers which are strong, are relatively light weight, and can have a large volume and which can be fabricated from thermoplastic polymers. Advantageously, the container body plastic remains thermoplastic, i.e., it is not cross-linked during fabrication, so that the polymer is recyclable. The thermoplastic container bodies of the invention can be provided with removably fastened or permanently fastened side lifting channels for use as front loading containers, or can be provided with a horizontal trunnion bar for use as a rear loading container.

In one embodiment, the refuse container of the invention comprises a thermoplastic polymeric body of generally rectangular shape defined by first and second opposed side walls, a front wall and a rear wall and bottom. A metal lifting sleeve is fastened horizontally on the exterior of each side wall to receive lift forks for lifting the container. At least a portion of each side wall above the lifting sleeve extends outwardly beyond at least a portion of the sleeve to provide support to the top of the lifting sleeve during lifting of the container. A plurality of vertical reinforcing ribs are provided in each side wall and are defined by the side portions of at least one vertical channel which is integrally formed in the side wall and which extends vertically into the horizontal portion of the side wall fastened to the interior of the metal sleeve so that at least a portion of the reinforcing ribs are positioned in the side walls behind the lifting sleeve.

The structural features provided in this embodiment of the invention reduce and more evenly distribute stresses on the container side wall so that repeated lifting of the container using the metal sleeves will not damage the container side wall even though the container may hold a large mass of waste. During lifting of the container, the portion of the side wall above and extending outwardly of the lifting sleeve converts a portion of the shear load on the side wall into a compressive load which is received by the upper outer wall portion. The vertical reinforcing ribs formed by the vertical channel or channels behind the lifting sleeve provide for increased side wall strength by absorbing a substantial portion of the shear load applied to the side wall. Preferably, the outwardly extending portion of the side wall above the lifting sleeve is provided by a plurality of outwardly extending vertical channels in the side wall which terminate in contact with a portion of the metal lifting sleeve. Advantageously, one or more vertical channels are also provided in the side wall below the lifting sleeve.

The side walls are also preferably provided with a plurality of horizontal reinforcing ribs which are defined by end or stepped portions of the rear walls of the vertically extending channels in the container side walls. At least a portion of the horizontal reinforcing ribs are advantageously located at or adjacent the horizontal portion of the side wall which is fastened to the metal sleeve. The horizontal ribs assist in strengthening the vertical reinforcing ribs formed by the sides of the vertical channels and also help to distribute the stresses across the container walls.

Plastic commercial size refuse container bodies provided according to another aspect of this invention are useful as both front loading refuse containers which include metal lifting sleeves on the side walls and/or as rear loading containers which include a trunnion bar attached to the top of the front wall. In this embodiment of the invention, the generally rectangular refuse container has a volume of about 1.5 cubic meters (2 cubic yards) or greater. A plurality of horizontally spaced vertical channels are integrally formed in each of the side walls and in each of the front and back walls such that the channels form a plurality of vertical reinforcing ribs and a plurality of horizontal reinforcing ribs in each of the walls. The side walls of the channels form the vertical reinforcing ribs. The horizontal reinforcing ribs are formed by end portions or stepped portions of the rear wall of the vertically extending channels in the walls of the container. The horizontal ribs are located at a plurality of vertical locations in each of the side walls and in each of the front and rear walls. The horizontally disposed and vertically disposed integral reinforcing ribs provided in the container walls resist deflection forces which can be exerted on the walls during lifting of the container, particularly when the container is filled with heavy loads. Advantageously, the bottom wall of the container also includes a plurality of integrally molded channels extending transversely to each other to strengthen the bottom wall of the container and assist in resisting deflective forces applied on the container bottom.

The refuse containers provided according to the invention can readily be made by injection molding processes so that the container body walls can have a controlled thickness in the range of less than about 10 millimeters, preferably between about 4 and about 8 millimeters. Special plastics of the cross-linked and/or thermosetting variety are not required in the manufacture of the refuse containers of the invention; thus, the refuse containers of the invention can be formed from any of various high strength thermoplastic materials such as high density polyethylene, which can readily be recycled by melting.

BRIEF DESCRIPTION OF THE DRAWINGS

In the drawings which form a portion of original disclosure of the invention.

DESCRIPTION OF THE PREFERRED EMBODIMENTS

In the following detailed description, various preferred embodiments of the invention are described in order to illustrate the invention and to enable practice of the invention. Specific terms are employed in order to describe the preferred embodiments. However, specific terms are used in a descriptive sense only and are not intended to limit the invention. It will also be understood that the invention is not to be limited to its preferred embodiments; but to the contrary, the invention includes various alternatives, modifications and equivalents within its spirit and scope as will be apparent to the skilled artisan.

Figure 1:
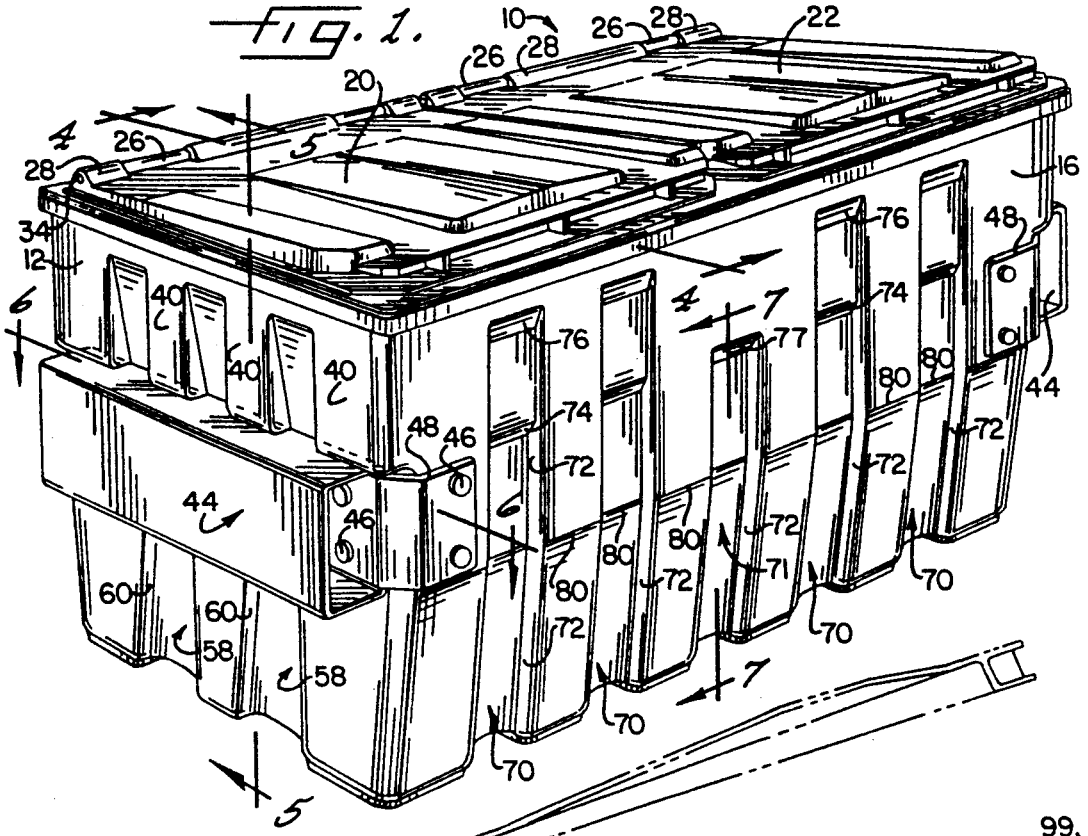
FIG. 1 is a perspective view of one preferred waste container according to the invention.
Figures 2, 3:
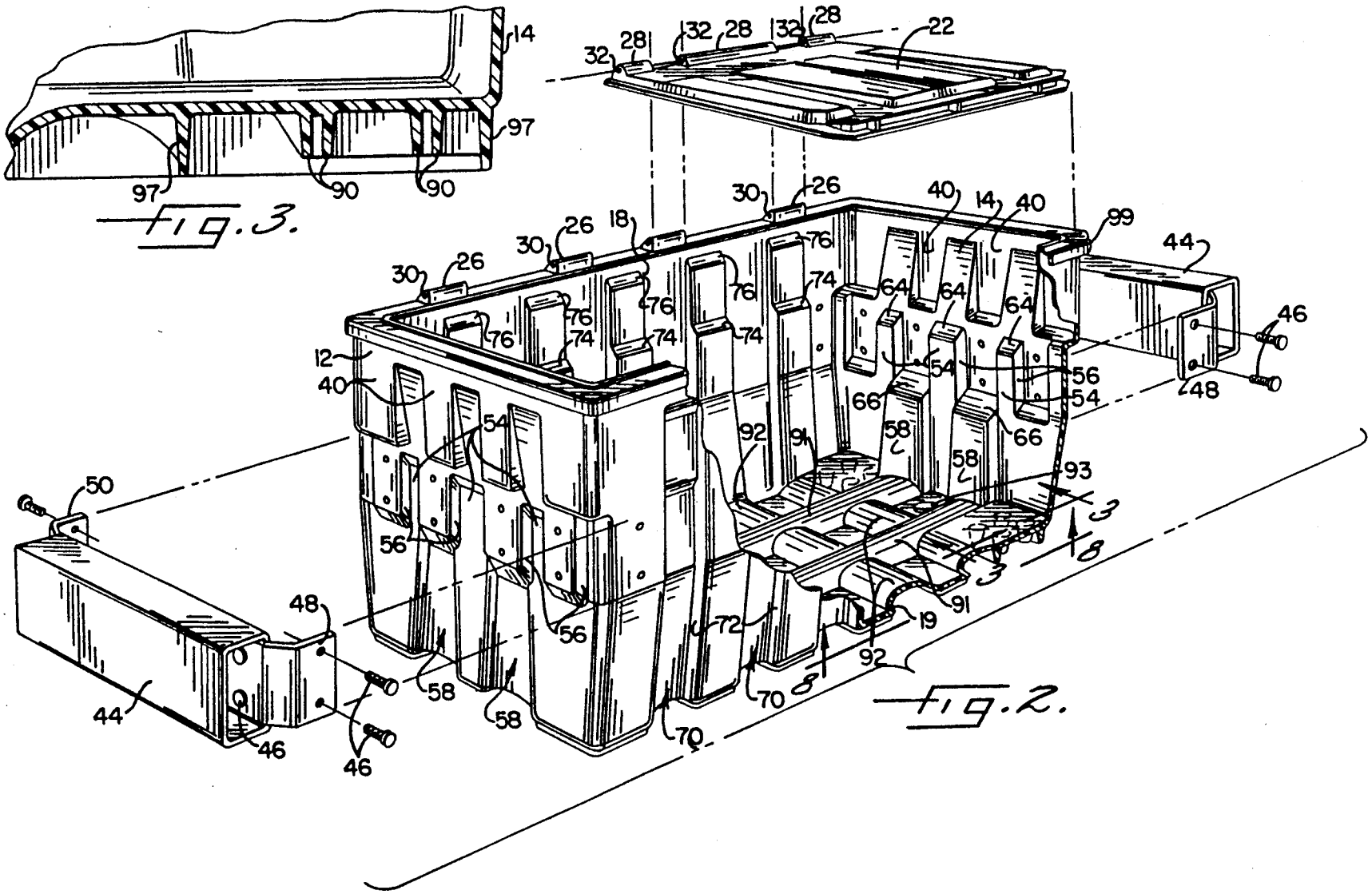
FIG. 2 is an exploded view in perspective of the waste container of FIG. 1, in which a portion of the front wall of the container has been cut away.
FIG. 3 is a cross-sectional view taken along line 3—3 of FIG. 2 and illustrates a portion of the bottom of the container body.

FIGS. 1 and 2 are perspective views of preferred front loading refuse containers provided according to the invention. A one piece container body 10 is formed by side walls 12 and 14, a front wall 16, a rear wall 18 and a bottom wall 19. A split lid comprising separate lid portions 20 and 22 is hingedly attached to the container body via alternating, upwardly extending bosses 26 integrally formed in the container body rear wall and by bosses 28 integrally formed in each lid member. Aligned bores 30 and 32 are provided in the body bosses 26 and lid bosses 28, respectively, so that a single hinge rod 34 can be provided through the aligned bores in order to connect the two lid members 20 and 22 to the container body 10.

Figure 5:
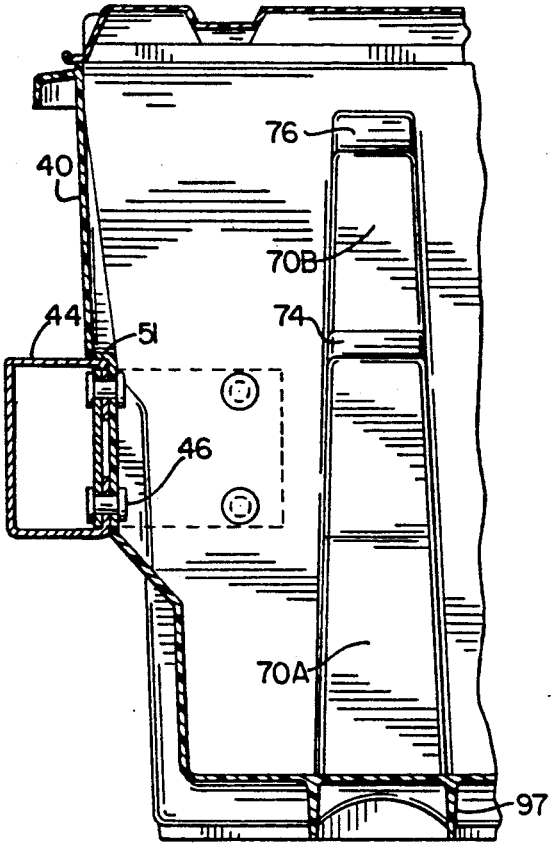
FIG. 5 is a partial front cross-sectional view taken along line 5—5 of FIG. 1.

Side walls 12 include a plurality of outwardly oriented channels 40 in the upper portion of the side wall. Metal lifting sleeves 44 are fastened via fasteners 46 to each of the side walls 12 and 14 just below channels 40. Each metal sleeve includes a forwardly and transversely extending portion 48 and a rearwardly and transversely extending portion 50. These extending portions of the metal sleeve, formed by extensions of the interior wall thereof, are attached to the front and rear walls, respectively, of the container body 10 and form integral striker plates on the front and rear wall of the container body. The outwardly extending channels 40 in the upper portion of the side walls 12 and 14 terminate in an undercut shoulder wall portion 51 (FIG. 5) to support a portion of the top 52 of the lifting sleeve 44.

As best seen in FIG. 2, there are a plurality of interiorly oriented, vertically extending channels 54 in each of the side walls 12 and 14 behind the lifting sleeve 44. The sides of channels 54 form a plurality of integral transverse reinforcing ribs 56 in the side walls of the container. These integral reinforcing ribs 56 are positioned behind lifting sleeve 44 to resist the shear forces which are applied to the container body wall by lifting sleeves 44 when the container is lifted by lifting sleeves 44.

There are also a plurality of lower channels 58 in the lower portion of each side wall. The sides of the channels 58 define further vertical reinforcing ribs 60 in the container side walls. Horizontally disposed reinforcing ribs 64 and 66 (FIG. 2) are also integrally formed in the container body side wall by the upper end portions of channels 54 and 58 respectively. The faces formed by the horizontal reinforcing ribs 64 and 66 are advantageously oriented diagonally downwardly so that the force of heavy objects dropped into the container will be deflected upon contact with the horizontal ribs.

Figure 4:
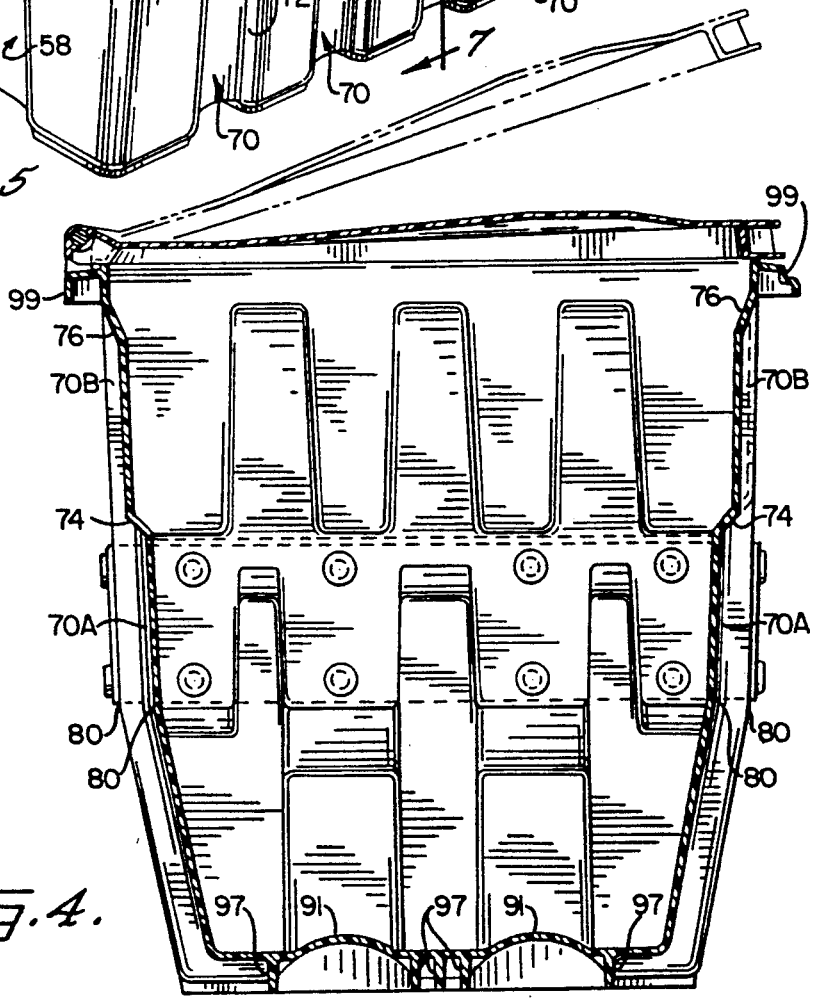
FIG. 4 is a side cross-sectional view of the refuse container shown in FIG. 1 taken along line 4—4 thereof.

As best seen in FIG. 1, there are four horizontally spaced, vertically extending channels 70 in the front wall 16 of the container body. A fifth channel 71 is formed in the center of the front wall and is shorter than channels 70. Channel 71 terminates at a horizontal end portion 77, (best seen in FIG. 7) which is positioned at about one-half the height of the front container wall. Vertical reinforcing ribs 72 are formed by the sides of the channels 70 and 71. As seen in FIG. 4, each of the channels 70 extends into the front wall of the container to a greater depth in the lower portion 70A of the channel than in the upper portion 70B of the channel.

The stepped portions 74 of each channel between the upper and lower portions 70A and 70B, form a plurality of horizontal reinforcing ribs which are spaced horizontally across the front wall of the container. The terminating upper end portions 76 of each channel 70 provide a second set of integral horizontally disposed reinforcing ribs which are horizontally spaced across the front wall 18. The terminating, horizontal end portion, 77 of channel 71 provides additional horizontal reinforcement. Further horizontal reinforcement is provided both in the front and the rear wall by wall break or knee 80 which extends across the front of the container wall. The portions of the container wall located above and below knee 80 are angled with respect to one another in an amount of, for example, 10°–20°.

It will be recognized that the horizontal reinforcing ribs 76, 74 and 77 cooperate with vertical reinforcing ribs 72 and with the integral knee joints 80 to strengthen the front wall of the container so that deflection of the container wall outwardly or inwardly is minimal even when the container wall is subjected to extremely high stresses.

As best seen in FIG. 2, the rear wall 18 of the container body is substantially identical to the front wall 16 with the exception that all five channels 70 extend substantially the full height of the container wall.

FIG. 3 illustrates a plurality of downwardly oriented brackets, 90 which are formed on the outer face of the bottom wall at each of the four corners of the container. The extensions 90 are advantageously employed for the mounting of wheels or casters. Alternatively, the brackets 90 can be employed for the mounting of replaceable, shock absorbing feet or the like on the bottom of the container.

Figure 6:
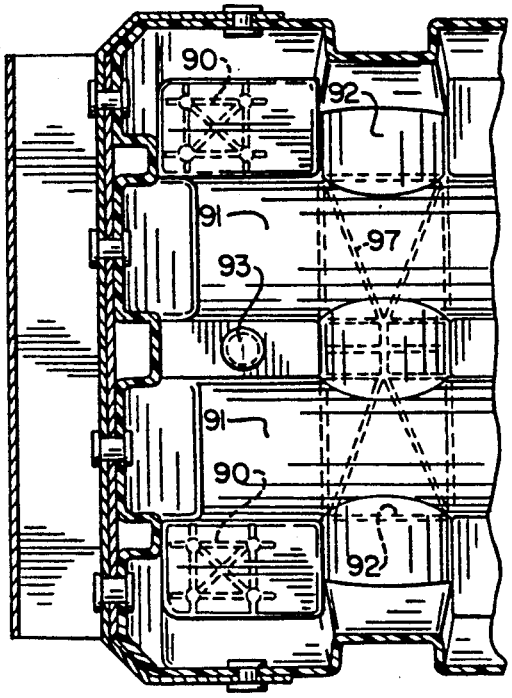
FIG. 6 is a partial top cross-sectional view taken along line 6—6 of FIG. 1.

Transversely oriented channels in the container bottom are seen in FIGS. 2 and 6. Two hemispherically cross-sectioned channels 91 extend from side to side of the container across the container bottom. The two longitudinal channels 91 are laterally spaced and substantially parallel. A set of five laterally spaced and parallel channels 92 are formed in the bottom wall and extend from front to back of the container. These channels intersect channels 91 as they extend across the container bottom.

The integrally formed, hemispherical channels 91 and 92 in the container bottom serve to strengthen the bottom, both against outward deflection caused by heavy refuse in the container, and against excessive inward deflection when the container is dropped on the ground following dumping.

The container bottom wall 19 also includes two drain holes 93 (best seen in FIGS. 2 and 6) located near each side wall 12. A removable plug (not shown) is advantageously provided for each drain hole. If desired, further drain holes 93 could be provided in other locations on the bottom wall of the container.

Figure 7:
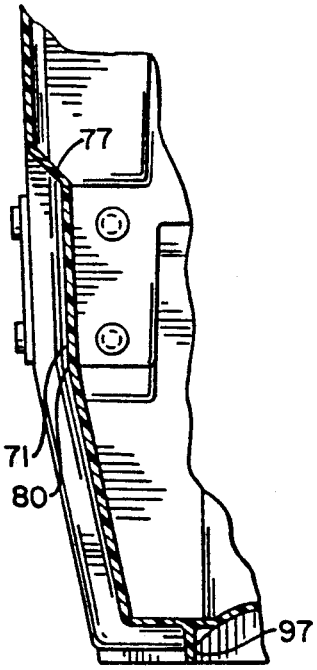
FIG. 7 is a partial cross-sectional view of the front container wall taken along line 8—8 of FIG. 7.
Figure 8:
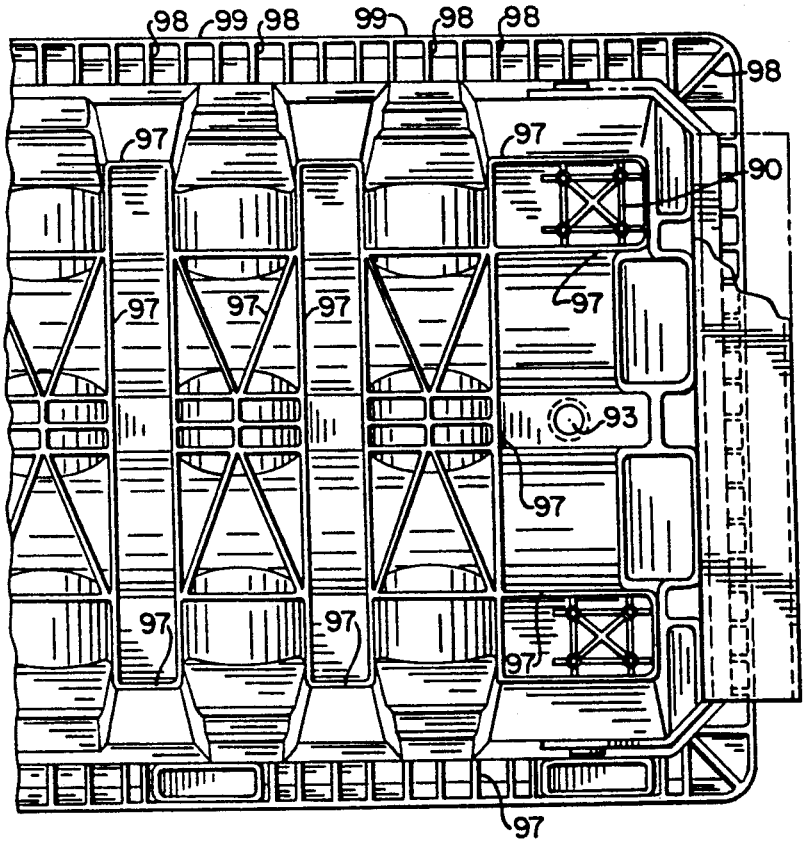
FIG. 8 is a partial bottom view shown from the direction of line 8—8 of FIG. 2 and illustrates a preferred ribbing structure employed underneath the container bottom wall.

Advantageously, downwardly projecting ribbing is also formed on the container bottom for extra strengthening of the container bottom and to provide a support surface for the container bottom. One preferred ribbing pattern is illustrated in FIG. 8. A plurality of ribs 97 are seen to be integrally formed on the bottom of the container bottom wall. The ribs are integrally connected to each other so that a continuous ribbing network is provided on the container bottom extending substantially across the bottom in both front-to-rear and side-to-side directions. As seen in FIG. 7, the exterior bottom ribs 97 may preferably form a support surface for the container.

FIG. 8 also illustrates integral ribbing 98 provided on the under side of the upper lip 99 of the container body. Lip 99 and ribbing 98 are dimensioned according to known DIN (Deutsche Industrial Norm) standards so that the container can be lifted and dumped by automated European comb lifting systems.

Figure 9:
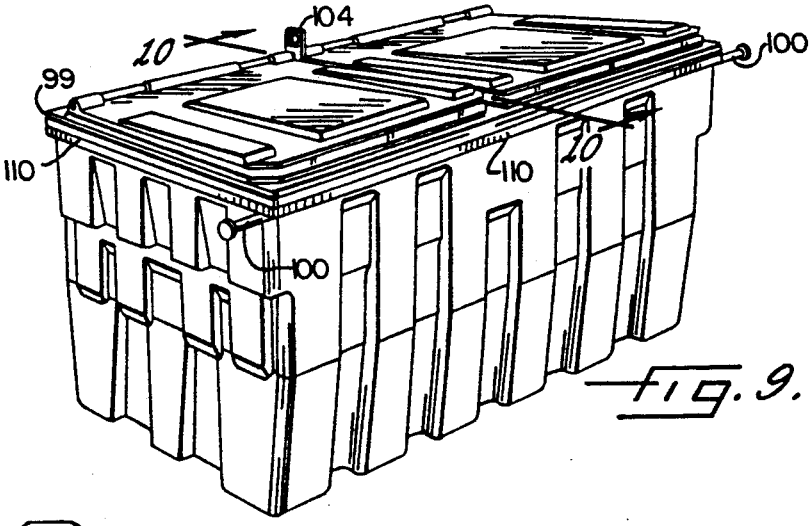
FIG. 9 is a preferred rear loading container provided according to the invention which includes a horizontal trunnion bar attached across the top front wall of the container body.
Figure 10:
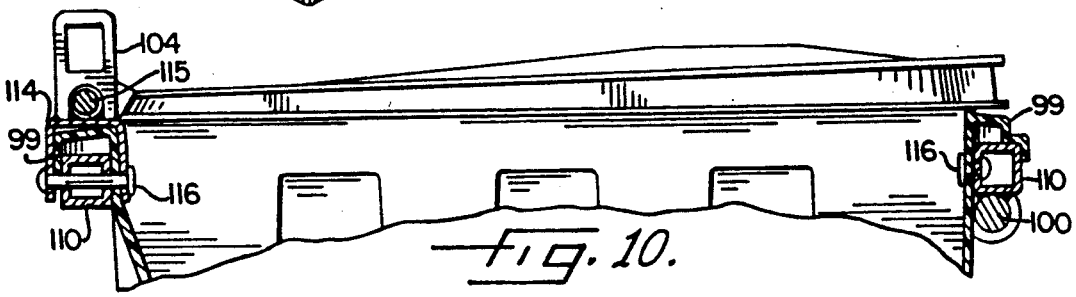
FIG. 10 is a partial side cross-sectional view taken along line 10—10 of FIG. 9 and illustrates a preferred manner of attaching the trunnion bar to the container body.

FIGS. 9 and 10 illustrate a rear loading container embodiment of the invention. Container body 10 is constructed in substantially identical form to the container bodies of FIGS. 1–7 except that the container is narrower from side-to-side according to industry-adopted specifications for rear lifting containers. A trunnion bar 100 is attached horizontally across at the top of the front wall of the container and a lifting bracket 104 is provided at the top of the rear wall of the container. The trunnion bar 100 and the lifting bracket 104 provide supports for lifting and inversion of the container by automatic refuse collection trucks. The trunnion bar and rear lifting bracket are suitably attached to the container body via a metal rectangular frame 110 which is fastened to the outer upper periphery of the container body, i.e., surrounding an upper portion of each of the four walls. As shown in FIG. 10, the rectangular frame member 110 can be partially supported in the integral container body lip 99. Advantageously, the trunnion bar 100 is attached by, for example, welding, to the lower face of the front bar of rectangular frame member 110. The rear lifting bracket 104 is advantageously attached to the rectangular frame member 110 via a U-shaped bracket 114 seen in FIG. 9. Alternatively the rear lifting member 104 can be attached to the hinge rod 115 which can be fabricated from steel or a similar load bearing metal. When suitably fabricated, hinge rod, 115, itself, could also be extended to form the metal lifting trunnion bar. It will be recognized that the rectangular shaped frame member 110 is suitably fastened via fasteners 116 to the exterior periphery of the container body 10 at various locations around the upper periphery of the container body.

The containers of the invention are advantageously manufactured by an injection molding process. Although various plastics can be used to form the container body, advantageously the container body is formed of thermoplastic high density polyethylene or a similar high strength plastic material. Container walls can range in thickness from between about 3 to about 12 millimeters. As will be apparent from the drawings, the container bodies of the invention achieve numerous structural advantages including substantial vertical and substantial horizontal integrally formed reinforcing ribs. Interior undercut wall portions are avoided in the container bodies of the invention so that injection molding can be used to mold the container bodies. Although the avoidance of undercut interior surfaces normally would limit the amount of horizontal reinforcement which could be provided in the container body, the refuse containers of the invention include substantial horizontal, integrally formed ribbing. This is achieved by advantageous use of stepped faces and end faces of integrally formed channels in the container body. Horizontal reinforcement is also provided by the knee joints extending across the front and rear faces of the container.

In order to cooperate most advantageously with automatic refuse lifting trucks, the containers shown in FIGS. 1–8 hereof can have a width of about 6–7 feet (about 2 meters). As noted above, the containers of FIGS. 9 and 10 have a lesser width. It will be recognized that container width is dictated by lifting forks and/or trunnion lifting devices which are standardized in the industry. The container can have any suitable front-to-rear depth, for example, 3–4 feet (1 meter) or greater. In one preferred embodiment of the invention, the container has top dimensions of a side-to-side width of about 6.5 feet (about 2 meters) and a front-to-back depth of about 3.5 feet (about 1 meter) and a height about 3.5 feet (about 1 meter) and each of the front, back and side walls are sloped inwardly to provide a total container volume of about 2 cubic yards (1.5 cubic meters). The container height, front-to-back depth and (where not set by side lift or trunnion bar standards), side-to-side width, can readily be increased or decreased to provide greater or lesser refuse container volumes.

The invention has been described in considerable detail with specific reference to its preferred embodiments. However, variations and modifications can be made within the spirit and scope of the invention as described in the foregoing detailed specification and defined in the appended claims.

That which is claimed is:

1. A container for receiving waste comprising a polymeric body of generally rectangular shape defined by first and second opposed side walls, a front wall, a rear wall and a bottom wall;

two metal lifting sleeves, each metal lifting sleeve comprising an interior face fastened horizontally on the exterior of each side wall to receive lift forks for lifting the container;

at least a portion of each side wall above and adjacent the lifting sleeve extending outwardly beyond at least a portion of the lifting sleeve for receiving compressive load from at least a portion of the top of the lifting sleeve during lifting of the container; and a plurality of vertical reinforcing ribs in each side wall, the vertical reinforcing ribs being defined by side portions of at least one vertical channel integrally formed in the side wall, wherein the vertical channel extends vertically into the horizontal portion of the side wall fastened to the interior face of the lifting sleeve so that at least a portion of the reinforcing ribs are positioned in the side wall behind the lifting sleeve.

2. The container of claim 1 wherein the polymeric body of generally rectangular shape is a one piece body composed of thermoplastic polymer.

3. The container of claim 2 wherein said outwardly extending portion of each side wall comprises at least one outwardly extending channel integrally formed in the container wall and terminating above the lifting sleeve for receiving compressive load from at least a portion of the lifting sleeve.

4. The container of claim 3 having a plurality of outwardly extending integrally formed channels in the upper portion of each side wall for receiving compressive load from the lifting sleeve.

5. The container of claim 2 wherein said plurality of vertical reinforcing ribs in each side wall are oriented substantially transversely to the plane defined by the sidewall.

6. The container of claim 5 having a plurality of vertical channels integrally formed in the side wall and extending into the horizontal portion of the side wall fastened to the interior face of the lifting sleeve.

7. The container of claim 5 additionally comprising a plurality of vertically extending channels integrally formed in the container side wall and being positioned below the horizontal portion of the side wall fastened to the lifting sleeve.

8. The container of claim 6 additionally comprising a plurality of horizontal ribs integrally formed in each of the container side walls, the horizontal ribs being formed by at least one of end and stepped portions of the vertically extending channels in the container side walls.

9. The container of claim 8 wherein at least a portion of the horizontal ribs integrally formed in each side wall of the container body are located adjacent the horizontal portion of the side wall fastened to the lifting sleeve.

10. The container of claim 2 wherein at least a portion of the interior face of the lifting sleeve extends forwardly and transversely of the lifting sleeve, said forwardly and transversely extending portion of the lifting sleeve being attached to a portion of the front wall of the container to thereby form a striker plate.

11. The container of claim 1 additionally comprising at least one lid member hingedly attached to the container body.

12. The container of claim 11 comprising at least two lid members hingedly attached to the container body.

13. The container of claim 11 wherein the container body comprises a plurality of spaced, upwardly extending bosses on the top of the rear wall, each of said bosses comprising a bore and wherein the lid is hingedly connected to the container body via a rod member extending through the bores in the bosses and being connected to the lid.

14. The container body of claim 6 wherein the bottom wall of the container body comprises a plurality of first integrally formed channels oriented in a front-to-rear direction and a plurality of second integrally formed channels oriented in the side-to-side direction, said first plurality of integrally formed channels and said second plurality of integrally formed channels intersecting each other.

15. The container of claim 14 additionally comprising a plurality of downwardly oriented, integrally formed ribs on the exterior of the container bottom.

16. A container for receiving waste comprising a one piece thermoplastic polymeric body of generally rectangular shape having a capacity of at least about 1.5 cubic meters, the container body being defined by first and second opposed side walls, a front wall, a rear wall and a bottom wall; a plurality of horizontally spaced, vertical channels integrally formed in each of the side and front and back walls, said channels forming a plurality of vertical reinforcing ribs and a plurality of horizontal reinforcing ribs in each of said walls, the vertical reinforcing ribs being formed by the side walls of said channels, and the horizontal ribs being formed by at least one of end and step portions of the vertical channels, said horizontal ribs being located at a plurality of vertical locations on each of said walls;

two metal lifting sleeves, each metal lifting sleeve comprising an interior face fastened horizontally on the exterior of each side wall to receive lift forks for lifting of the container;

a plurality of integrally formed channels in the upper portion of each side wall, said plurality of channels extending outwardly beyond at least a portion of the lifting sleeve to receive compressive force from at least a portion of the top of the lifting sleeve during lifting of the container.

17. The container of claim 16 wherein at least a portion of the horizontal ribs are formed by stepped portions of said channels.

18. The container of claim 16 wherein at least a portion of the horizontal reinforcing ribs in each of said sidewalls are positioned at or adjacent the horizontal portion of the side wall fastened to the metal lifting sleeve.

19. The container of claim 16 wherein the bottom wall of the container body comprises a plurality of first integrally formed channels oriented in a front-to-rear direction and a plurality of second integrally formed channels oriented in a side-to-side direction, said first plurality of integrally formed channels and said second plurality of integrally formed channels intersecting each other.

20. The container of claim 19 additionally comprising a plurality of downwardly oriented, integrally formed ribs on the exterior of the container bottom.

21. The container of claim 16 additionally comprising a trunnion bar attached horizontally across the top of the front wall of the container.

22. The container of claim 21 additionally comprising a lifting bracket attached to the top of the rear wall of the container.

23. The container of claim 21 additionally comprising a rectangular metal frame fastened to the exterior, upper periphery of the container body, said trunnion bar being attached to the lower face of the front of the rectangular frame member.

24. The container of claim 16 additionally comprising at least one lid member hingedly attached to the container body.

* * * * *